US007847778B2

(12) United States Patent
Chien et al.

(10) Patent No.: US 7,847,778 B2
(45) Date of Patent: Dec. 7, 2010

(54) GATE DRIVING CIRCUIT AND DRIVING METHOD THEREOF

(75) Inventors: Chih-Yuan Chien, Hsin-Chu (TW); Yu-Ju Kuo, Hsin-Chu (TW); Wan-Jung Chen, Hsin-Chu (TW); Kuo-Hsing Cheng, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 784 days.

(21) Appl. No.: 11/758,775

(22) Filed: Jun. 6, 2007

(65) Prior Publication Data

US 2008/0150925 A1 Jun. 26, 2008

(30) Foreign Application Priority Data

Dec. 26, 2006 (TW) ..... 95149055 A

(51) Int. Cl.
*G09G 3/36* (2006.01)

(52) U.S. Cl. ..... 345/98; 345/100

(58) Field of Classification Search ..... 345/98, 345/100; 377/72, 78
See application file for complete search history.

(56) References Cited

U.S. PATENT DOCUMENTS

| | | | |
|---|---|---|---|
| 6,690,347 | B2 | 2/2004 | Jeon et al. |
| 6,922,217 | B2 | 7/2005 | Kim |
| 7,215,315 | B2 | 5/2007 | Morosawa et al. |
| 7,369,111 | B2 * | 5/2008 | Jeon et al. ..... 345/100 |
| 2003/0189542 | A1 | 10/2003 | Lee et al. |
| 2004/0046729 | A1 | 3/2004 | Moon |
| 2004/0165692 | A1 | 8/2004 | Moon et al. |
| 2004/0183770 | A1 | 9/2004 | Yoo et al. |

FOREIGN PATENT DOCUMENTS

| | | |
|---|---|---|
| CN | 1519630 | 8/2004 |
| CN | 1832048 | 9/2006 |
| CN | 1868003 | 11/2006 |
| CN | 1873829 | 12/2006 |

OTHER PUBLICATIONS

English language translation of abstract and pertinent parts of CN 1519630 Aug. 11, 2004.
English language translation of abstract and pertinent parts of CN 1873829 Dec. 6, 2006.
English translation of abstract and pertinent parts of CN 1868003 Nov. 22, 2006.
English language translation of abstract and pertinent parts of CN 1832048.

* cited by examiner

*Primary Examiner*—Kevin M Nguyen
(74) *Attorney, Agent, or Firm*—Thomas, Kayden, Horstemeyer & Risley, LLP

(57) ABSTRACT

A gate driving circuit for driving plural scan lines of a liquid crystal display includes N driving circuit units and a control unit. Each of the N driving circuit units sequentially outputs a driving signal to drive a corresponding scan line of the scan lines. The control unit outputs a positive-phase and an opposite-phase clock signal to control the N driving circuit units. After an $N^{th}$ driving circuit unit of the N driving circuit units outputs the driving signal, the control unit transmits a control signal to at least one of the N driving circuit units. A method for driving the foregoing gate driving circuit is also disclosed.

15 Claims, 6 Drawing Sheets

GATE DRIVING CIRCUIT AND DRIVING METHOD THEREOF

RELATED APPLICATIONS

This application claims priority to Taiwan Patent Application Serial Number 95149055, filed Dec. 26, 2006, which is herein incorporated by reference.

BACKGROUND

1. Field of Invention

The present invention relates to a gate driving circuit. More particularly, the present invention relates to a gate driving circuit in a liquid crystal display.

2. Description of Related Art

In a general liquid crystal display, the driving circuit is one of the most significant components and an essential factor of product quality and cost. FIG. 1 shows a gate driving circuit of a general liquid crystal display. The gate driving circuit 100 includes driving circuit units 102 and a control unit 104. The control unit 104 generates a power source VSS, and outputs clock signals CK and XCK whose phases are opposite to each other, so as to control each of the driving circuit units 102. The driving circuit units 102 sequentially output driving signals $G_1, G_2, \ldots, G_N$ to the corresponding scan lines.

First of all, the control unit 104 transmits a start signal ST to the $1^{st}$ driving circuit unit 102, so as to drive the $1^{st}$ driving circuit unit 102 to output the driving signal $G_1$. Then, the $1^{st}$ driving circuit unit 102 transmits the driving signal $G_1$ to the $2^{nd}$ driving circuit unit 102, so as to drive the $2^{nd}$ driving circuit unit 102 to output the driving signal $G_2$. The rest of the driving circuit units 102 output the driving signals as described above.

Additionally, the driving signal $G_2$ output from the $2^{nd}$ driving circuit unit 102 is transmitted back to the $1^{st}$ driving circuit unit 102, so as to release the accumulated charges of the $1^{st}$ driving circuit unit 102. That is, the driving signal output from the next driving circuit unit 102 is transmitted back to the previous driving circuit unit 102, so as to release the accumulated charges of the previous driving circuit unit 102.

FIG. 2 shows the driving circuit unit shown in FIG. 1. The transistor M3 receives the driving signal output from the next driving circuit unit 102. When the transistor M3 receives the driving signal output from the next driving circuit unit 102 to be turned on, the charges accumulated in the node Q are released through the transistor M3. Therefore, the driving circuit units 102 can output more accurate driving signals and be used as long as possible. However, the last driving circuit unit 102 does not receive any signal to release the accumulated charges thereof, so the last driving circuit unit 102 usually has more and more accumulated charges as operational time goes on, so that the last driving circuit unit 102 cannot operate as effectively as the others.

For the foregoing reasons, there is a need to solve the problem of accumulated charges in the last driving circuit unit.

SUMMARY

It is therefore an object of the present invention to solve the problem of accumulated charges in the last stage of the driving circuit units, so that the last stage of the driving circuit units can operate normally.

It is another object of the present invention to release the accumulated charges of driving circuit units, so that the driving circuit units can output correct driving signals and be used as long as possible.

In accordance with one embodiment of the present invention, a gate driving circuit is provided. The gate driving circuit drives plural scan lines of a liquid crystal display, and includes N driving circuit units and a control unit, in which N is a positive integer. Each of the N driving circuit units sequentially outputs a driving signal to drive a corresponding scan line of the scan lines. The control unit outputs a positive-phase clock signal and an opposite-phase clock signal to control the N driving circuit units. After an $N^{th}$ driving circuit unit of the N driving circuit units outputs the driving signal, the control unit transmits a control signal to at least one of the N driving circuit units.

In accordance with another embodiment of the present invention, a method for driving the foregoing gate driving circuit is provided. The method includes the steps of sequentially driving the N driving circuit units so that each of the N driving circuit units sequentially outputs a corresponding driving signal; and transmitting a control signal to at least one of the N driving circuit units by the control unit after an $N^{th}$ driving circuit unit of the N driving circuit units outputs the corresponding driving signal.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the preferred embodiment, with reference made to the accompanying drawings as follows.

DESCRIPTION OF THE PREFERRED EMBODIMENTS

Detailed illustrative embodiments of the present invention are disclosed herein. However, specific details disclosed herein are merely representative for purposes of describing exemplary embodiments of the present invention. This invention may, however, be embodied in many alternate forms and should not be construed as limited to the embodiments set forth herein.

Figure 1:
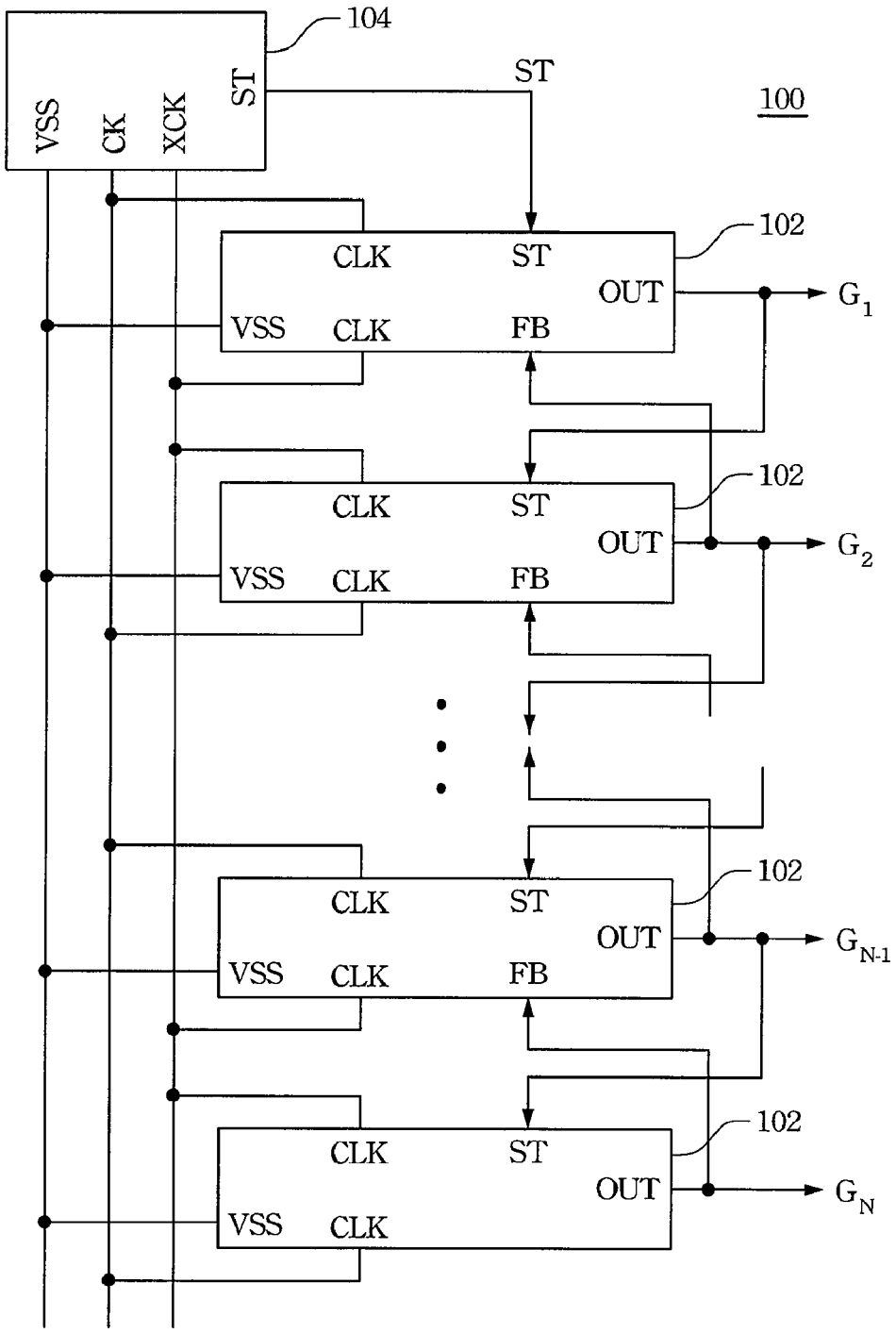
Fig. 1 (PRIOR ART)
FIG. 1 shows a gate driving circuit of a general liquid crystal display.
Figure 2:
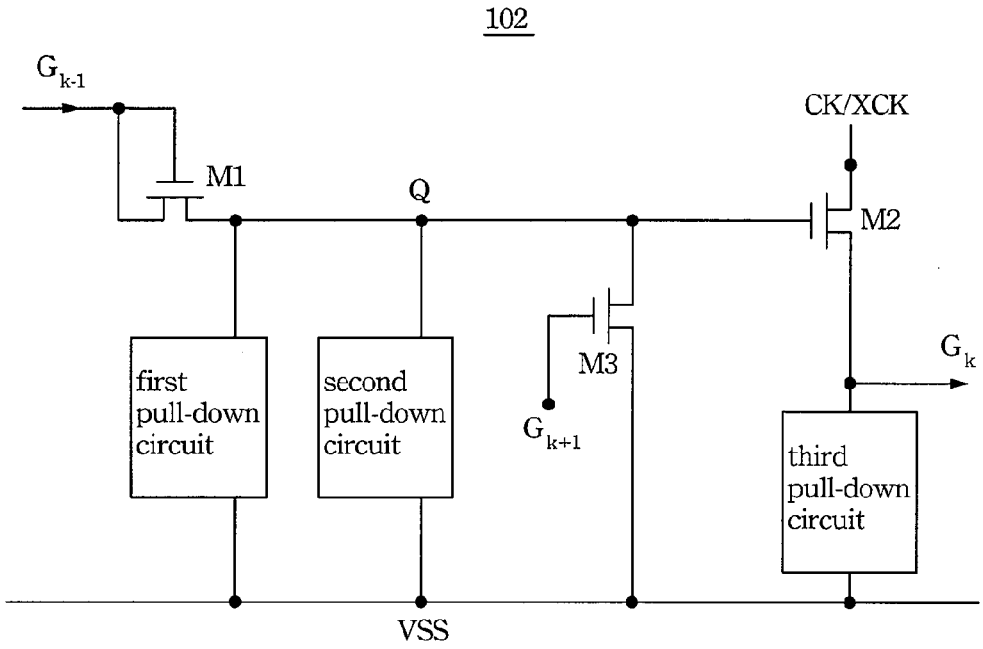
Fig. 2 (PRIOR ART)
FIG. 2 shows the driving circuit unit shown in FIG. 1.
Figure 3:
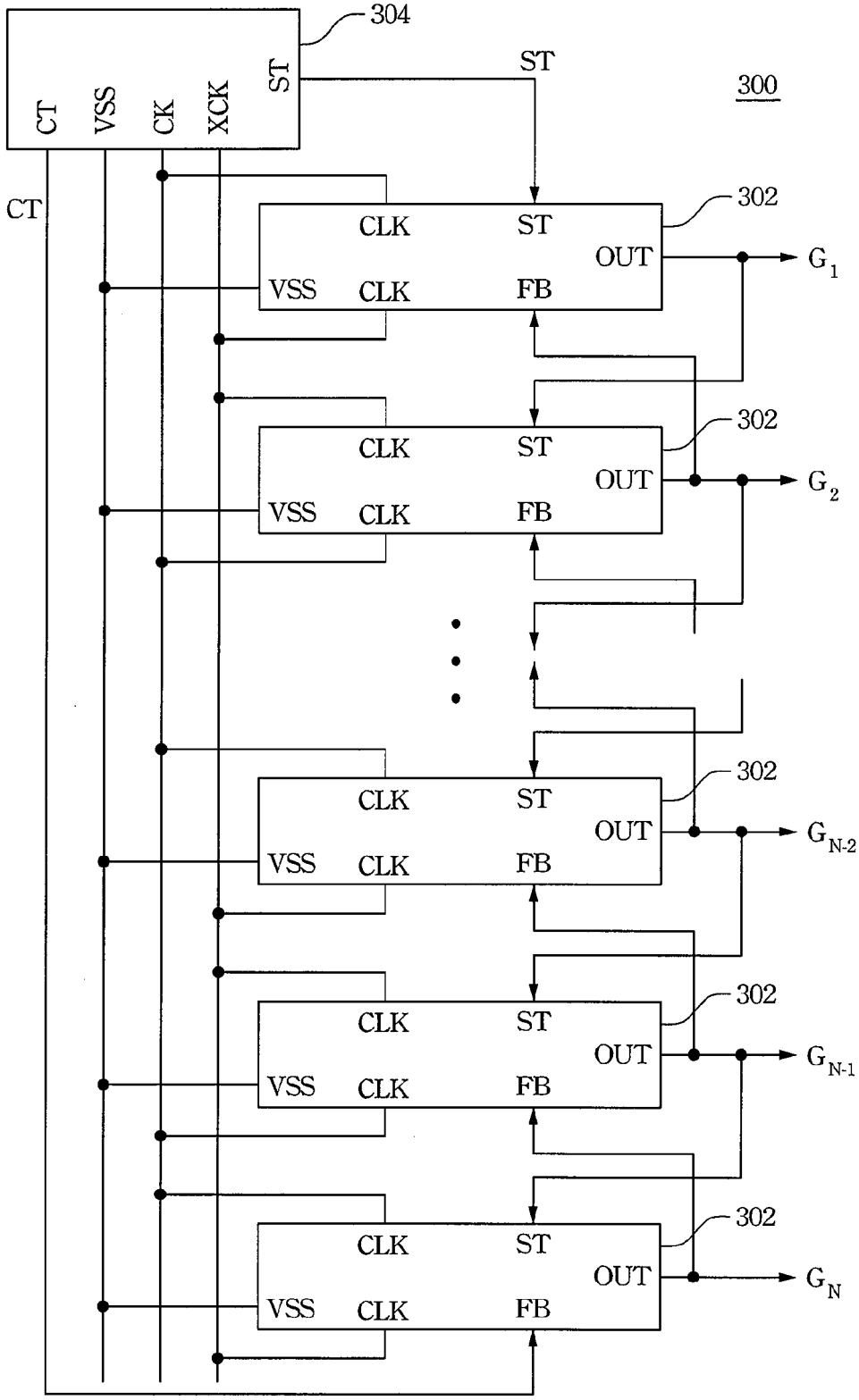
FIG. 3 shows a gate driving circuit according to one embodiment of the present invention.

FIG. 3 shows a gate driving circuit according to one embodiment of the present invention. The gate driving circuit 300 drives N scan lines of a liquid crystal display, and includes N driving circuit units 302 and a control unit 304, in which N is a positive integer. The N driving circuit units 302 includes from a $1^{st}$ driving circuit unit 302 to an $N^{th}$ driving circuit unit 302, which sequentially output driving signals $G_1, G_2, \ldots, G_N$, respectively, so as to drive the N scan lines of the liquid crystal display. The control unit 304 outputs a positive-phase clock signal CK and an opposite-phase clock signal XCK, the phases of which are opposite to each other, to control the N driving circuit units 302.

In the gate driving circuit 300, the control unit 304 transmits a start signal ST to the $1^{st}$ driving circuit unit 302 at first, so as to drive the $1^{st}$ driving circuit unit 302 to output the driving signal $G_1$. Then, the $1^{st}$ driving circuit unit 302 transmits driving signal $G_1$ to the $2^{nd}$ driving circuit unit 302, so as to drive the $2^{nd}$ driving circuit unit 302 to output the driving signal $G_2$. That is, the driving signal $G_K$ output from the $K^{th}$ driving circuit unit 302 is transmitted to the $(K+1)^{th}$ driving circuit unit 302, so as to drive the $(K+1)^{th}$ driving circuit unit 302, in which K=1, 2, . . . , N−1. So, the driving circuit units 302 sequentially output the driving signals to the corresponding scan lines.

Furthermore, the driving signal $G_2$ output from the $2^{nd}$ driving circuit unit 302 is transmitted back to the $1^{st}$ driving circuit unit 302, so as to release the accumulated charges of the $1^{st}$ driving circuit unit 302. The driving signal $G_3$ output from the $3^{rd}$ driving circuit unit 302 is transmitted back to the $2^{nd}$ driving circuit unit 302 as well, so as to release the accumulated charges of the $2^{nd}$ driving circuit unit 302. That is, the driving signal $G_K$ output from the $K^{th}$ driving circuit unit 302 is transmitted back to the $(K-1)^{th}$ driving circuit unit 302, so as to release the accumulated charges of the $(K-1)^{th}$ driving circuit unit 302. Moreover, after the $N^{th}$ driving circuit unit 302 outputs the driving signal $G_N$, the control units 304 transmits a control signal CT to the $N^{th}$ driving circuit unit 302, so as to release the accumulated charges of the $N^{th}$ driving circuit unit 302.

Figure 4:
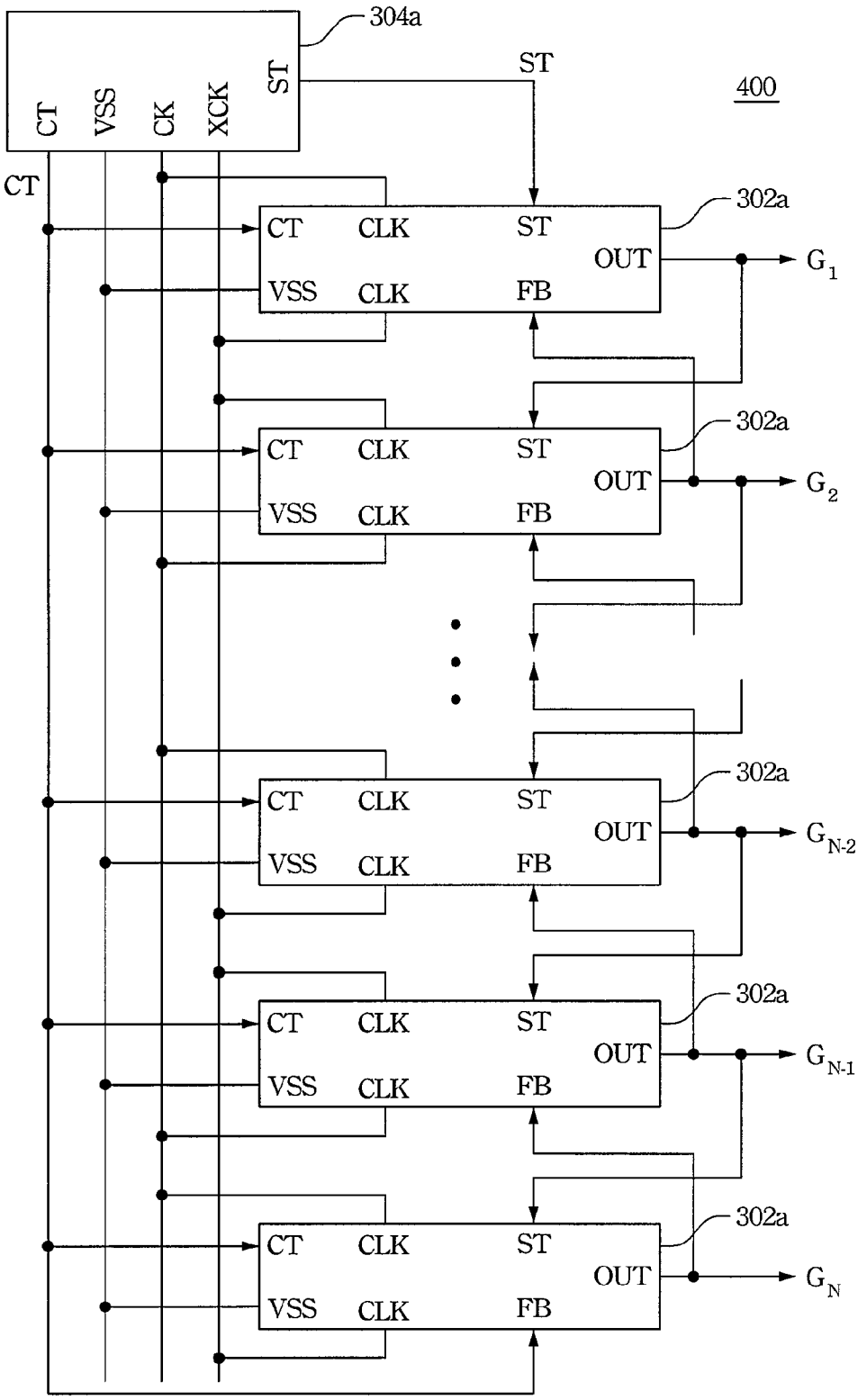
FIG. 4 shows a gate driving circuit according to another embodiment of the present invention.

FIG. 4 shows a gate driving circuit according to another embodiment of the present invention. Comparing FIG. 4 to FIG. 3, the N driving circuit units 302*a* further receive the control signal CT output from the control unit 304*a* to release the accumulated charges thereof. That is, after the $N^{th}$ driving circuit unit 302*a* outputs the driving signal $G_N$, the control unit 304*a* transmits the control signal CT to the N driving circuit units 302*a*, so as to release the accumulated charges thereof. In addition, the control unit 304*a* can also transmit the control signal CT to only one driving circuit unit 302*a* or a few driving circuit units 302*a;* that is, the control unit 304*a* can also transmit the control signal CT to at least one of the driving circuit units 302*a* to release the accumulated charges thereof.

Figure 5:
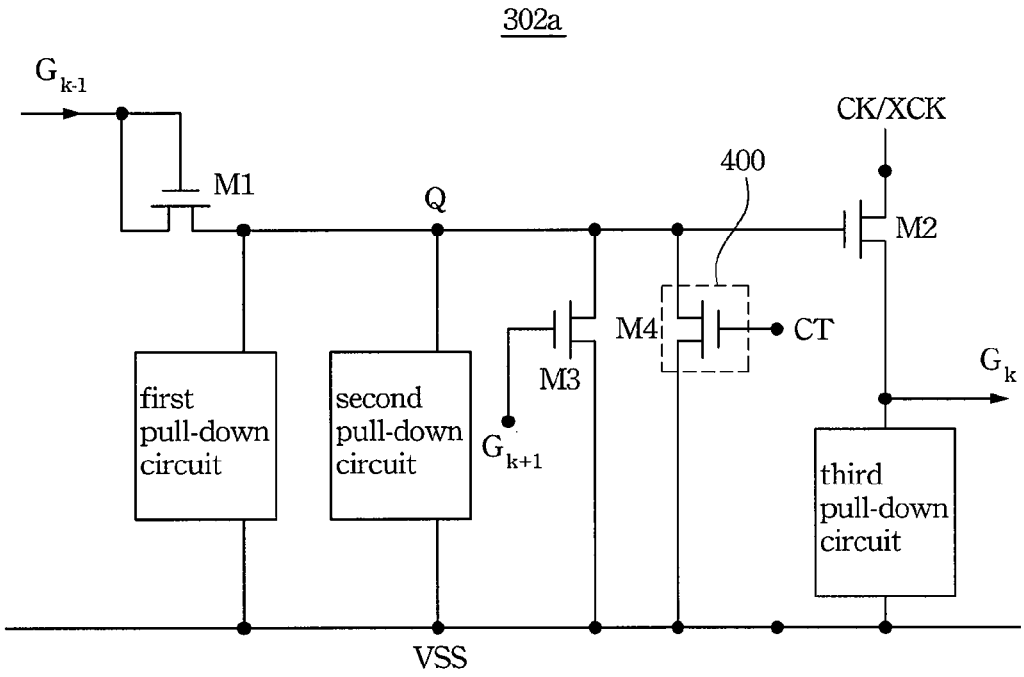
FIG. 5 shows the driving circuit unit shown in FIG. 4.

FIG. 5 shows the driving circuit unit shown in FIG. 4. The structure of the driving circuit unit 302*a* is approximately the same as the structure of the driving circuit unit 302 shown in FIG. 3, and further includes a reset unit 400. The reset unit 400 receives the control signal CT output from the control unit 304*a,* so as to release the accumulated charges of the driving circuit unit 302*a*. The reset unit 400 includes a transistor M4, and the gate electrode of the transistor M4 receives the control signal CT. When the transistor M4 receives the control signal CT to be turned on, the charges accumulated in the node Q are released through the transistor M4.

Figure 6:
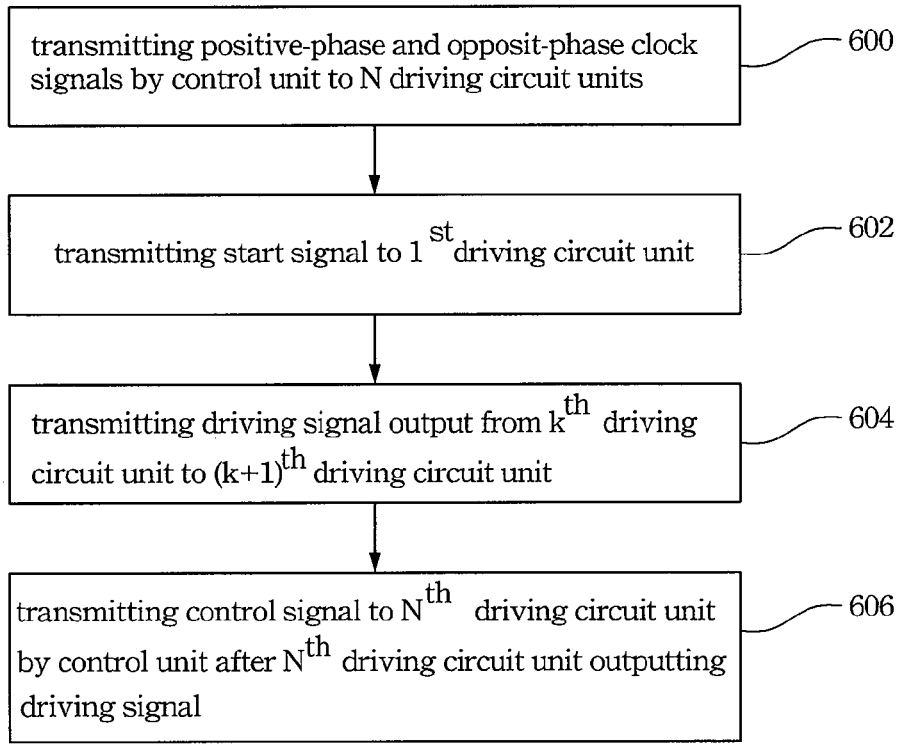
FIG. 6 shows a flow chart of the method for driving the foregoing gate driving circuit according to one embodiment of the present invention.

Additionally, in accordance with another embodiment of the present invention, a method for driving the foregoing gate driving circuit is provided. FIG. 6 shows a flow chart of the method for driving the foregoing gate driving circuit according to one embodiment of the present invention. Referring to FIG. 3 and FIG. 6, in Step 600, the positive-phase clock signal CK and the opposite-phase clock signal XCK, phases of which are opposite to each other, are transmitted from the control unit 304 to the N driving circuit units 302 so as to control the N driving circuit units 302. Then in Step 602, a start signal ST is transmitted from the control unit 304 to the $1^{st}$ driving circuit unit 302, so as to drive the $1^{st}$ driving circuit unit 302 to output the driving signal $G_1$. In Step 604, the driving signal $G_K$ output from the $K^{th}$ driving circuit unit 302 is transmitted to the $(K+1)^{th}$ driving circuit unit 302, so as to drive the $(K+1)^{th}$ driving circuit unit 302 to output the driving signal $G_{K+1}$, in which K=1, 2, . . . , N−1. Sequentially, in Step 606, after the $N^{th}$ driving circuit unit 302 outputs the driving signal $G_N$, the control signal CT is transmitted from the control unit 304 to the $N^{th}$ driving circuit unit 302, so as to release the accumulated charges of the $N^{th}$ driving circuit unit 302.

Referring to FIG. 4 and FIG. 5, the foregoing method can further include the steps of providing a reset unit 400 for receiving the control signal CT for at least one of the N driving circuit units 302 to release the accumulated charges, and transmitting the control signal CT to the reset unit 400 of each of the N driving circuit units 302 by the control unit 304 after the $N^{th}$ driving circuit unit 302 outputs the driving signal $G_N$, so as to release the accumulated charges of each of the N driving circuit units 302 by the reset unit 400. For the foregoing embodiment, the accumulated charges of the gate driving circuit can be reduced, and the lifetime and reliability of the gate driving circuit can be therefore increased as well.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A gate driving circuit for driving plural scan lines of a liquid crystal display, comprising:

N driving circuit units being as same as one another and sequentially outputting driving signals to drive corresponding scan lines, wherein N is a positive integer; and a control unit outputting a positive-phase clock signal and an opposite-phase clock signal to control the N driving circuit units, wherein after an $N^{th}$ driving circuit unit of the N driving circuit units outputs the driving signal, the control unit transmits a control signal to the $N^{th}$ driving circuit unit.

2. The gate driving circuit as claimed in claim 1, wherein the $N^{th}$ driving circuit units comprises:

a reset unit for receiving the control signal to release accumulated charges.

3. The gate driving circuit as claimed in claim 2, wherein after the $N^{th}$ driving circuit unit outputs the driving signal, the control unit transmits the control signal to the reset unit.

4. The gate driving circuit as claimed in claim 2, wherein the reset unit comprises a transistor having a gate electrode for receiving the control signal.

5. The gate driving circuit as claimed in claim 1, wherein the control unit transmits a start signal to a $1^{st}$ driving circuit unit of the N driving circuit units.

6. The gate driving circuit as claimed in claim 1, wherein a driving signal output from a $K^{th}$ driving circuit unit of the N driving circuit units is transmitted to a $(K+1)^{th}$ driving circuit unit of the N driving circuit units, wherein K=1, 2, . . . , N−1.

7. The gate driving circuit as claimed in claim 1, wherein a phase of the positive-phase clock signal and a phase of the opposite-phase clock signal are opposite to each other.

8. A method for driving the gate driving circuit as claimed in claim 1, comprising:

sequentially driving the N driving circuit units so that each of the N driving circuit units sequentially outputs a corresponding driving signal to drive a corresponding one of scan lines; and transmitting a control signal to an $N^{th}$ driving circuit unit of the N driving circuit units by the control unit after the $N^{th}$ driving circuit unit of the N driving circuit units outputting the corresponding driving signal.

9. The method as claimed in claim 8, further comprising:

providing a reset unit for receiving the control signal, in the $N^{th}$ driving circuit unit.

10. The method as claimed in claim 9, wherein the step of transmitting the control signal to the $N^{th}$ driving circuit unit by the control unit further comprises:

transmitting the control signal to the reset unit by the control unit after the $N^{th}$ driving circuit unit outputting the driving signal.

11. The method as claimed in claim 8, wherein the step of sequentially driving the N driving circuit units further comprises:

transmitting a start signal to a $1^{st}$ driving circuit unit of the N driving circuit units by the control unit.

12. The method as claimed in claim 8, wherein the step of sequentially driving the N driving circuit units further comprises:

transmitting a positive-phase clock signal and an opposite-phase clock signal to the N driving circuit units by the control unit.

13. The gate driving circuit as claimed in claim 1, wherein after the $N^{th}$ driving circuit unit outputs the driving signal, the control unit transmits the control signal to all of the N driving circuit units.

14. The gate driving circuit as claimed in claim 13, wherein each of the N driving circuit units comprises:

a reset unit for receiving the control signal to release the accumulated charges.

15. The method as claimed in claim 8, further comprising:

transmitting the control signal to all of the N driving circuit units by the control unit after the $N^{th}$ driving circuit unit outputting the corresponding driving signal.

* * * * *